US006044542A

United States Patent [19]

Apprille, Jr. et al.

[11] Patent Number: 6,044,542

[45] Date of Patent: Apr. 4, 2000

[54] RAZOR CARTRIDGE WITH METAL CLIP RETAINING BLADES

[75] Inventors: Domenic Vincent Apprille, Jr., Arlington; Katherine Elizabeth Anderson, Swampscott, both of Mass.

[73] Assignee: The Gillette Company, Boston, Mass.

[21] Appl. No.: 09/195,898

[22] Filed: Nov. 19, 1998

[30] Foreign Application Priority Data

Nov. 25, 1997 [EP] European Pat. Off. ..... 97203691

[51] Int. Cl.[7] ..... B26B 21/18

[52] U.S. Cl. ..... 29/525.05; 30/50; 29/509

[58] Field of Search ..... 30/50, 346.5, 346.37; 76/DIG. 8, 104.1; 29/505, 509, 525.05

[56] References Cited

U.S. PATENT DOCUMENTS

| | | | |
|---|---|---|---|
| 1,290,641 | 1/1919 | Munroe . | |
| 1,890,334 | 12/1932 | Muros . | |
| 1,911,996 | 5/1933 | Gaisman . | |
| 4,133,566 | 1/1979 | Miller | 29/525.05 |
| 4,270,268 | 6/1981 | Jacobson | 30/47 |
| 4,378,633 | 4/1983 | Jacobson | 30/47 |
| 4,378,634 | 4/1983 | Jacobson | 30/47 |
| 4,442,598 | 4/1984 | Jacobson | 30/47 |
| 4,488,357 | 12/1984 | Jacobson | 30/57 |
| 4,492,024 | 1/1985 | Jacobson | 30/87 |
| 4,492,025 | 1/1985 | Jacobson | 30/87 |
| 4,498,235 | 2/1985 | Jacobson | 30/47 |
| 4,551,916 | 11/1985 | Jacobson | 30/50 |
| 4,573,266 | 3/1986 | Jacobson | 30/41 |
| 4,621,424 | 11/1986 | Jacobson | 30/41 |
| 5,063,667 | 11/1991 | Jacobson | 30/41 |
| 5,761,814 | 6/1998 | Anderson et al. | 30/50 |
| 5,787,586 | 8/1998 | APprille, Jr. et al. | 30/47 |

FOREIGN PATENT DOCUMENTS

| | | |
|---|---|---|
| 4313 371 A1 | 10/1993 | Germany . |
| 416 377 | 1/1967 | Sweden . |
| 1 587 317 | 4/1981 | United Kingdom . |
| WO 94/11163 | 5/1994 | WIPO . |
| PCT/US95/12997 | 4/1996 | WIPO . |
| WO 96/10473 | 4/1996 | WIPO . |

*Primary Examiner*—Douglas D. Watts
*Attorney, Agent, or Firm*—Fish & Richardson P.C.

[57] ABSTRACT

A razor cartridge including a housing, blades mounted on said housing, and a metallic retaining clip that wraps around the housing and retains the blades on the housing, the housing including fulcrum portions extending outward beyond adjacent surface portions on two sides of the fulcrum portions, the clips having end portions that have been bent over the fulcrum portions beyond the elastic limit of the clips, the housing also having wedge portions making interference fits with the ends of the retaining clips.

9 Claims, 6 Drawing Sheets

RAZOR CARTRIDGE WITH METAL CLIP RETAINING BLADES

BACKGROUND OF THE INVENTION

The invention relates to razor cartridges having blades retained by metal clips.

In one type of movable-blade razor cartridge design, as shown for example in U.S. Pat. No. 4,378,634, blades can move up and down in slots in a cartridge housing against resilient arms during shaving. Metal clips on the housing retain the blades in the slots and determine the positions of the cutting edges of the blades in the at-rest position. In manufacture, the blades are first loaded into the housing; then a U-shaped clip is positioned over the housing and blades, and the legs of the clip are bent around the bottom of the housing.

SUMMARY OF THE INVENTION

In one aspect, the invention features, in general, a razor cartridge including a housing, blades mounted on the housing, and a metallic retaining clip that wraps around the housing and retains the blades on the housing. The housing has a fulcrum portion that extends outward beyond adjacent surface portions of the housing on two sides of the fulcrum portion, and the retaining clip is bent over the fulcrum portion beyond the elastic limit of the clip.

Certain implementations of the invention include one or more of the following features. In certain implementations there is a fulcrum portion for each of the two ends of the clip. The fulcrum portion tapers and has a blunt upper surface. The fulcrum portion is deformed and reduced in height by pressure applied to the fulcrum portion during bending of the clip over the fulcrum portion. The clip has a notch that is aligned with a notch post on the housing, and the clip bends at the fulcrum at a narrowed portion of the clip adjacent to the notch. The housing has a raised edge adjacent to an edge of the clip that positions the clip on the housing. The blades are movably mounted in slots in the housing. The blades are mounted on a top portion of the housing, and the ends of the clip are located at a bottom portion of the housing. The housing is recessed adjacent to the ends of the clip to receive the end portions of the clip during bending.

In another aspect, the invention features, in general a razor cartridge including a housing, blades mounted on the housing and a retaining clip. The housing has a wedge portion that extends outward beyond an adjacent portion and makes an interference fit with an end of the clip so as to facilitate retaining the clip on the housing.

In certain implementations, the housing has a raised edge adjacent to an edge of the clip that positions the clip on the housing, and the wedge portion extends sideways from the raised edge. The wedge portion has an angled surface at the interference fit, and the end portion of the clip has a mating angled surface. A portion of the wedge portion overlies a portion of the clip at the interference fit.

In other aspects the invention features housings as already described for use in razor cartridges and methods of assembling razor cartridges using the housings and clips as already described.

Embodiments of the invention may have one or more of the following advantages. The use of fulcrum portions and wedge portions permits longer clips to be used and thicker clip material to be used without having the end portions of the clips spring back to too large an extent after forming. The longer and thicker clips facilitate use on cartridge housings that have been made wider in order to accommodate a third blade.

Other advantages and features of the invention will be apparent from the following description of the preferred embodiment thereof and from the claims.

DESCRIPTION OF THE PREFERRED EMBODIMENT

Figure 1:
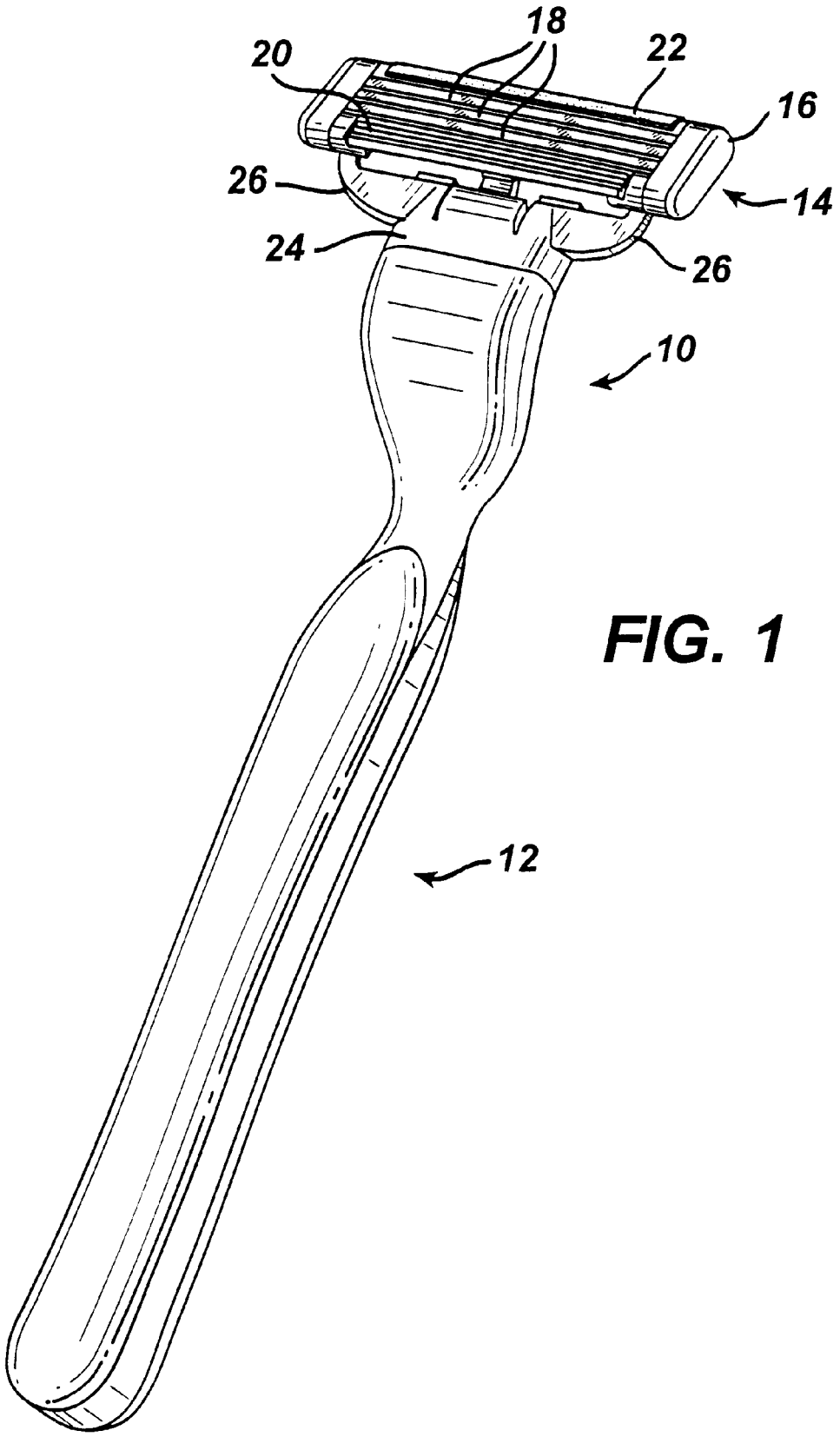
FIG. 1 is a perspective view of a razor according to the invention.

Referring to FIG. 1, shaving razor 10 includes handle 12 and replaceable shaving cartridge 14. Cartridge 14 includes molded plastic housing 16, which carries three blades 18, guard 20 and cap 22. Cartridge 14 also includes plastic interconnect member 24 on which housing 16 is pivotally mounted. Interconnect member 24 removably and fixedly attaches to handle 12 and has two arms 26 that pivotally support housing 16 at its two sides. Cartridge 14 is shown in its spring-biased, upward position in FIG. 1.

Figure 2:
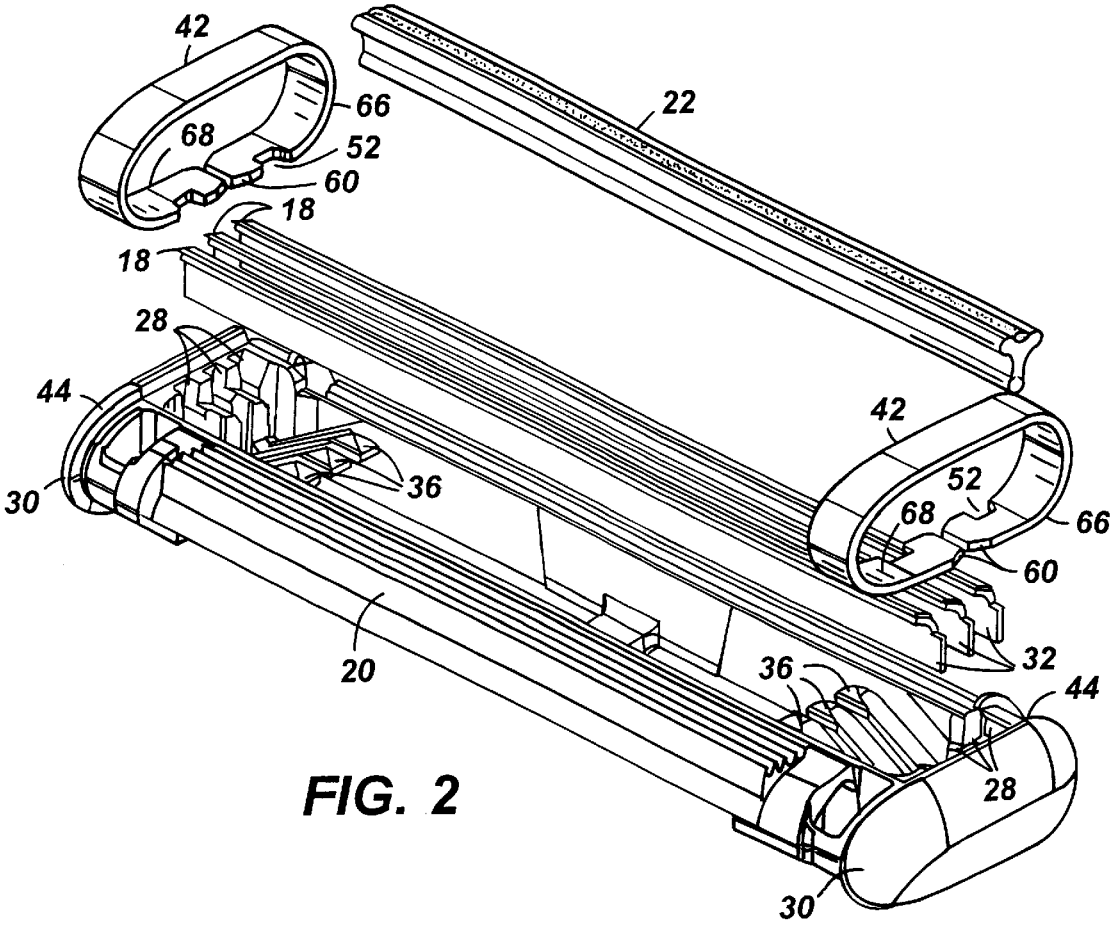
FIG. 2 is an exploded perspective view of a blade unit of the FIG. 1 razor.

Referring to FIG. 2, housing 16 of cartridge 14 has inwardly facing slots 28 in side walls 30 for receiving the ends of base portions 32 of blades 18. Housing 16 also has respective pairs of resilient arms 36 on which each blade 18 is resiliently supported. Blades 18 are located in a substantially unobstructed region 38 between side walls 30 to provide for ease of rinsing of the cartridge during use.

Cap 22 provides a lubricous shaving aid and is received in slot 40 at the rear of housing 16. Cap 22 may be made of a material comprising a mixture of a hydrophobic material and a water leachable hydrophilic polymer material, as is known in the art and is described, e.g., in U.S. Pat. Nos. 5,113,585 and 5,454,164, which are hereby incorporated by reference. Guard 20 includes a finned elastomeric unit molded on the front of housing 16 to engage and stretch the user's skin; other skin engaging protrusions, e.g., as described in U.S. Pat. No. 5,191,712, which is hereby incorporated by reference, can be used.

Metal clips 42 are secured at the respective sides of housing 16 inside of raised edges 44 of side walls 30 in order to retain blades 18 within housing 16 and to locate the cutting edges of spring-biased blades 18 at a desired exposure when in the at-rest position. Clips 42 also wrap around the bottom of housing 16 and prevent the removal of the ends of arms 26 of interconnect member 24. Clips 42 are made of 0.018" thick aluminum material, which is thicker than the material used in the clips of the blade unit of the commercial embodiment of the type of design described in the above-mentioned U.S. Pat. No. 4,378,634. In addition, the arms of the clips that are bent around the bottom of housing 16 are both longer than those employed in the commercial embodiment of the type of design described in the above-mentioned patent, because there are three blades (instead of two) and the housing thus is wider. The thicker material and the longer arms to be bent cause the arms to tend to elastically return to a larger extent after forces bending the clips around the housing have been released. Housing 16 includes certain features (described below) to maintain the thicker, longer clips in a desired final position.

Figure 3:
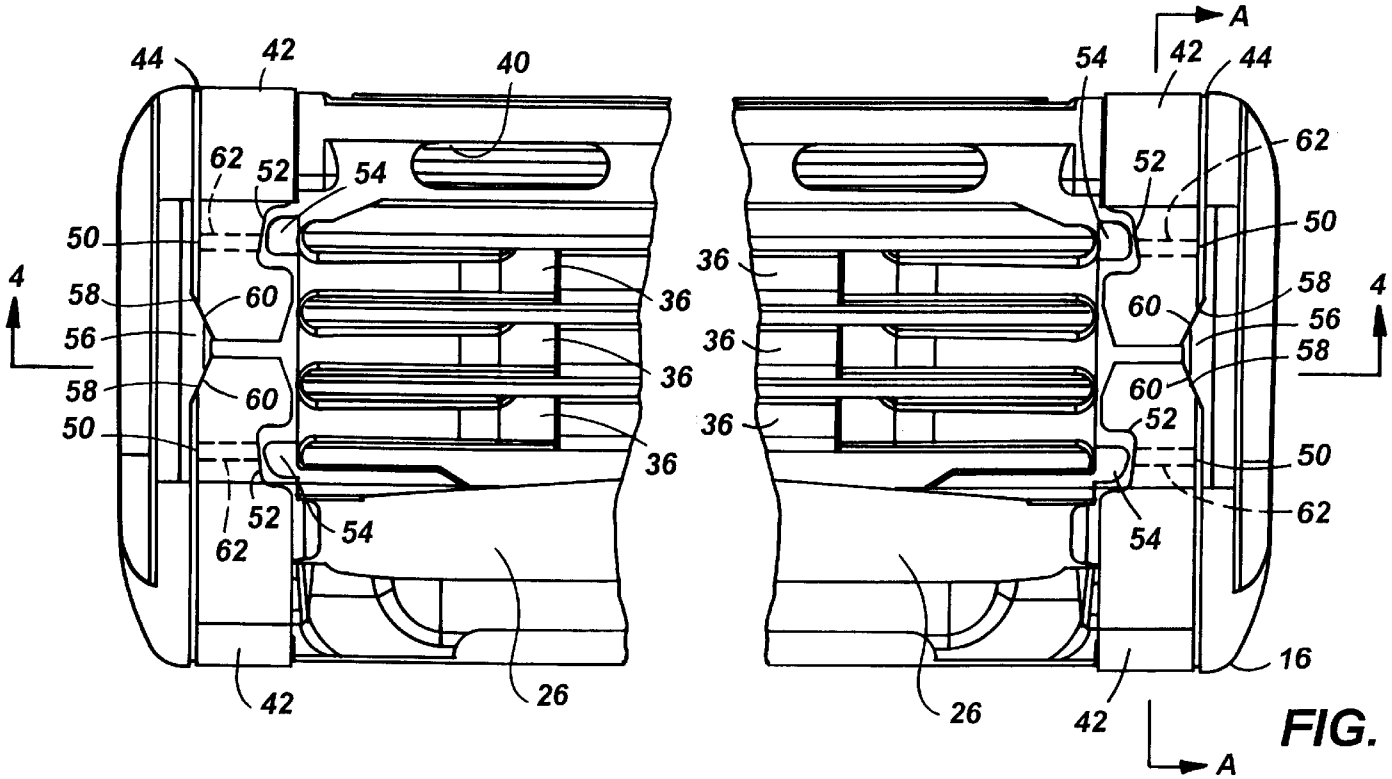
FIG. 3 is a partial bottom view of the FIG. 2 blade unit.

Referring to FIG. 3, it is seen that the end portions 50 of clips 42 have notches 52 that are aligned with notch posts 54 (see also FIG. 4) of housing 14. It is also seen that housing 16 has wedge portions 56 that extend in from raised edges 44 and have angled surfaces 58 that contact angled surfaces 60 of end portions 50 of clips 42. Wedge portions 56 (see also FIG. 4) and the contacting surfaces 60 of clips 42 make an interference fit in order to help retain the ends of clips 42 on housing 16.

Figure 4:
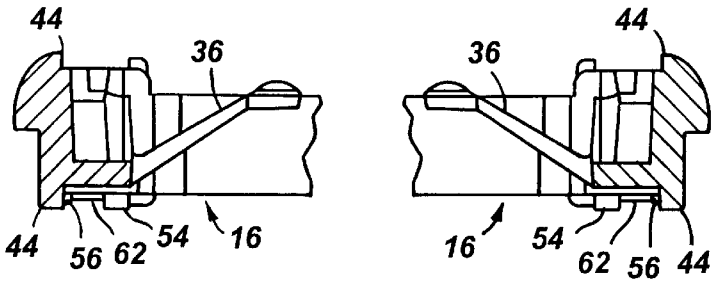
FIG. 4 is a vertical sectional view, taken at 4—4 of FIG. 3, of a housing of the FIG. 2 blade unit.
Figure 5:
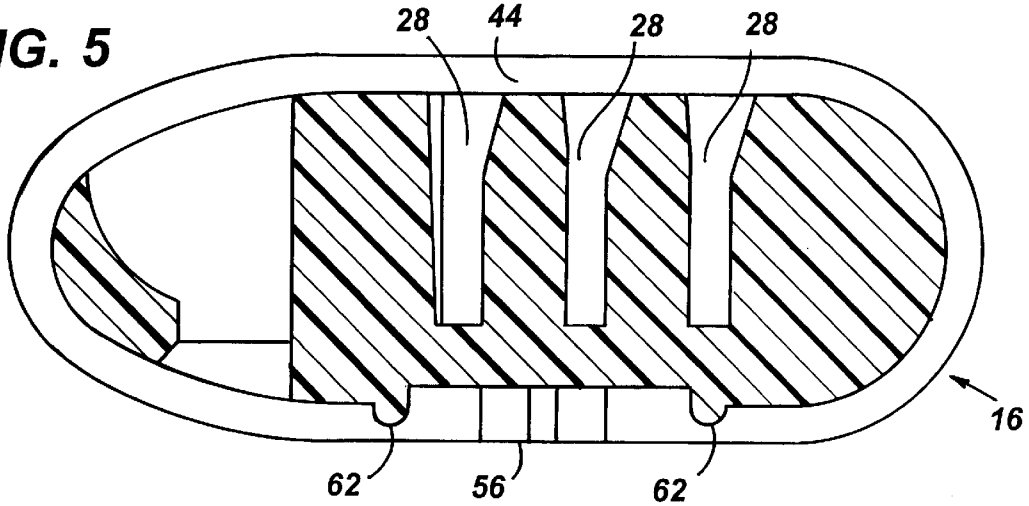
FIG. 5 is a vertical sectional view, taken at A—A of FIG. 3, of the FIG. 4 cartridge housing.

Referring to FIGS. 4 and 5, it is seen that housing 16 has fulcrums 62 that extend outward beyond the adjacent surface portions of housing 16 on both sides of fulcrums 62. As shown in FIG. 5, fulcrums 62 have a semicircular cross-section and therefore are tapered and have a blunt upper surface.

In manufacture, blades 18 are located on housing 16 by inserting the ends of base portions 32 in slots 28 and depressing the blades downward against resilient arms 36. Prior to assembly, retaining clips 42 are U-shaped, and the portion of the U that joins the two legs has the same contour as the upper portion of housing 16 within raised edges 44. The upper portions of the preassembled clips 42 thus have the same shape of the upper portions of clips 42 as shown in FIG. 2. Prior to assembly, the two legs of the U-shaped clip (which legs correspond to portions 66, 68 in FIG. 2) are directed straight downward and parallel to each other, and leg 66 is shorter than leg 68.

Figure 6:
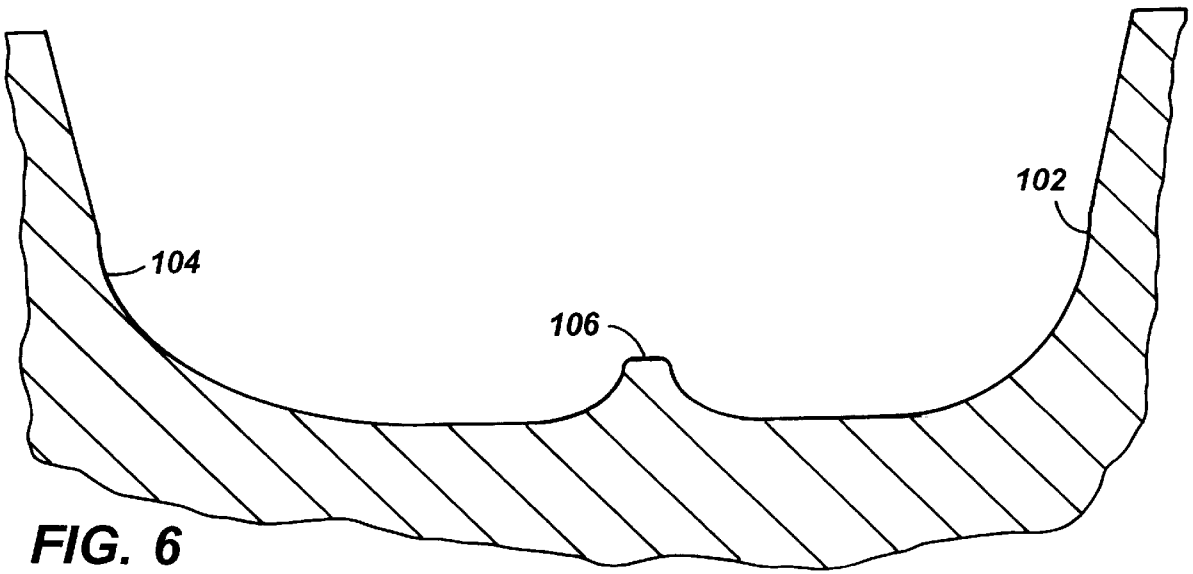
FIG. 6 is a partial vertical sectional view showing a forming die used to bend retaining clips around the FIG. 4 cartridge housing.
Figure 7:
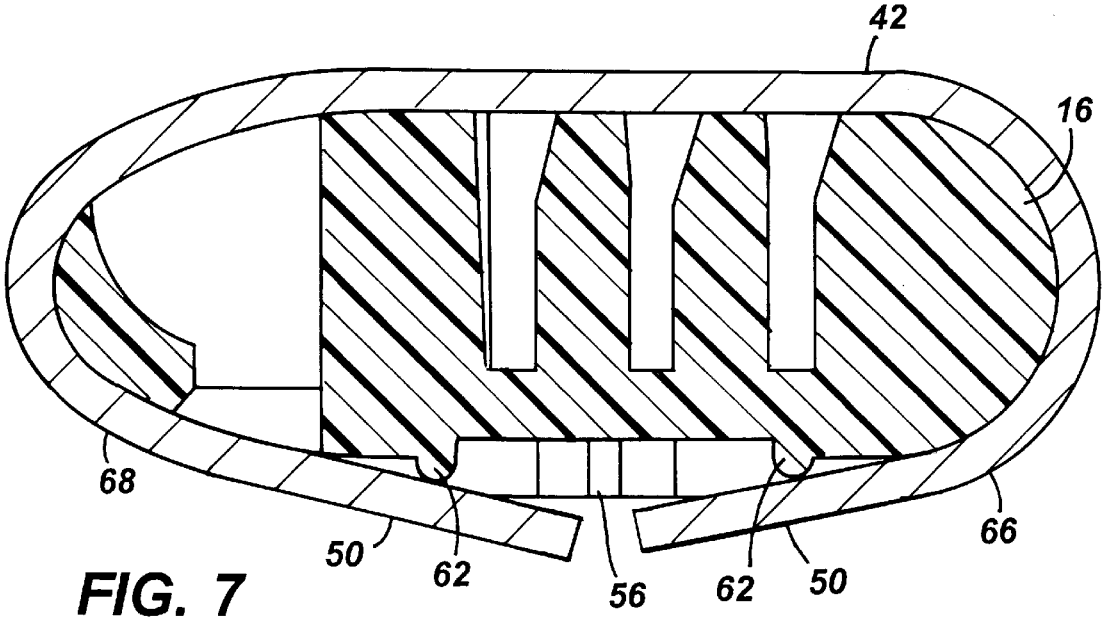
FIGS. 7, 8, and 9 are vertical sectional views, taken at A—A of FIG. 3, showing the FIG. 4 housing and a retaining clip at three different stages during the assembly of the clip on the housing.

The clip/housing/blade assembly (with the upper portion of clips 42 seated on housing 16 inside of raised edges 44) is directed downward against forming die 100 shown in FIG. 6. Surfaces 102, 104 of die 100 deflect legs 66 and 68 inward as the housing/blade/clip assembly is brought closer to die 100. This causes the legs 66, 68 of clip 42 to initially bend around the bottom of housing 16 to the position shown in FIG. 7. At this stage in the forming process, the end portions 50 of legs 66, 68 have just made initial contact with fulcrums 62. (In FIGS. 7–10, the base portions 32 of blades 18 and the ends of arms 26 are not shown on housing 16, though they are present during these stages of the manufacturing process and in the final assembly.)

Figure 8:
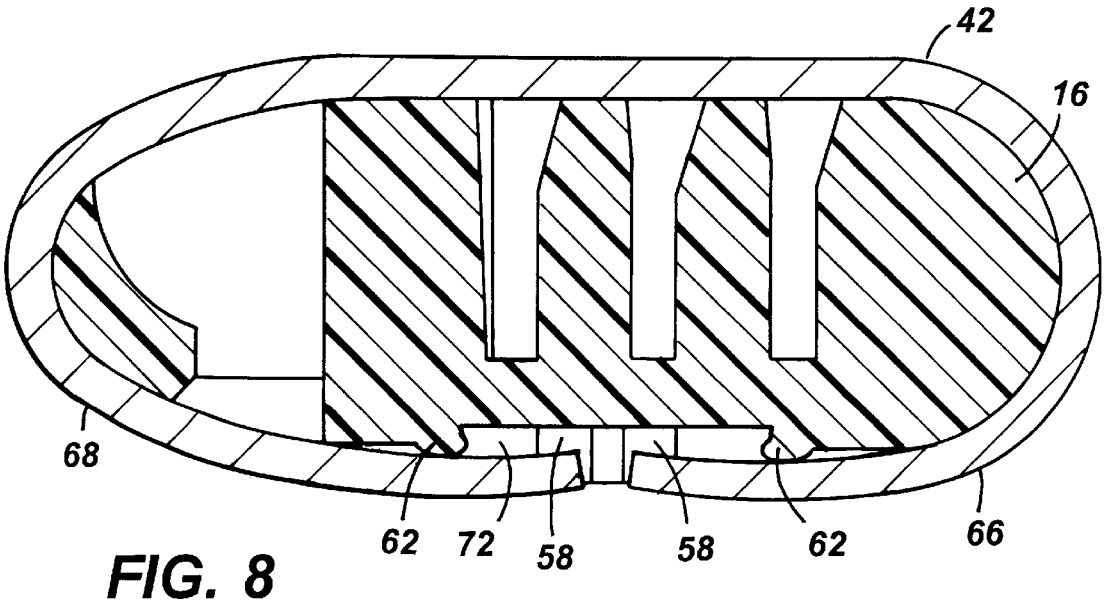

Referring to FIG. 8, with further advancement of the housing/blade/clip assembly toward die 100, the end portions 50 of the clips 42 tend to bend around fulcrums 62 at regions nearby notches 52 where clips 42 are thinner. Simultaneously with bending of clips 42 around fulcrums 62, fulcrums 62 begin to be crushed from the resulting forces, and the crushed material of fulcrums 62 is directed toward recess 72. At the same time, angled surfaces 60 of clips 42 move past angled surfaces 58 of wedge portions 56 (FIG. 3), and notches 52 begin to pass over notch posts 54 (FIGS. 3, 4).

Figure 9:
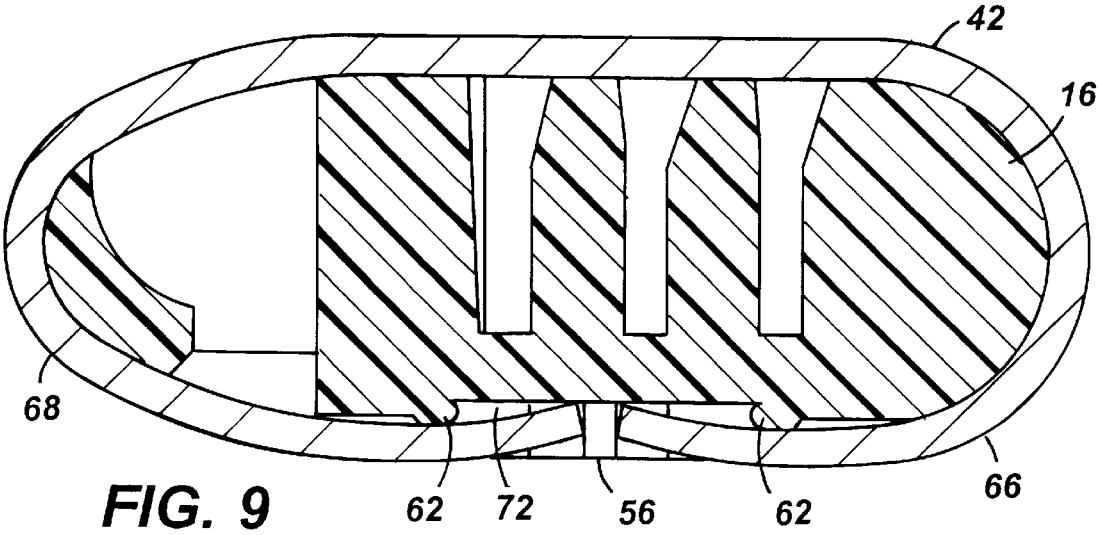

Referring to FIG. 9, further advancement of the housing/blade/clip assembly toward the forming die causes the ends 70 of the clips to contact the bottom of recess 72 of housing 16 in the position of their most deflected travel. At this point, fulcrums 62 have been crushed flat, with displaced material in recess 72, and ends 50 have been permanently bent beyond the elastic limit of the clip material at the regions of the clips overlying fulcrums 62. At the same time, angled surfaces 60 of clips 42 travel further over angled surfaces 58 of wedge portions 56 (FIG. 3), and the tops of wedge portions 56 are deformed (i.e., swaged) by projection 106 of forming die 100, causing displaced wedge material to slightly overly the ends of clips 42 and to create an interference fit that exerts a normal spring force against wedge portions 56.

Figure 10:
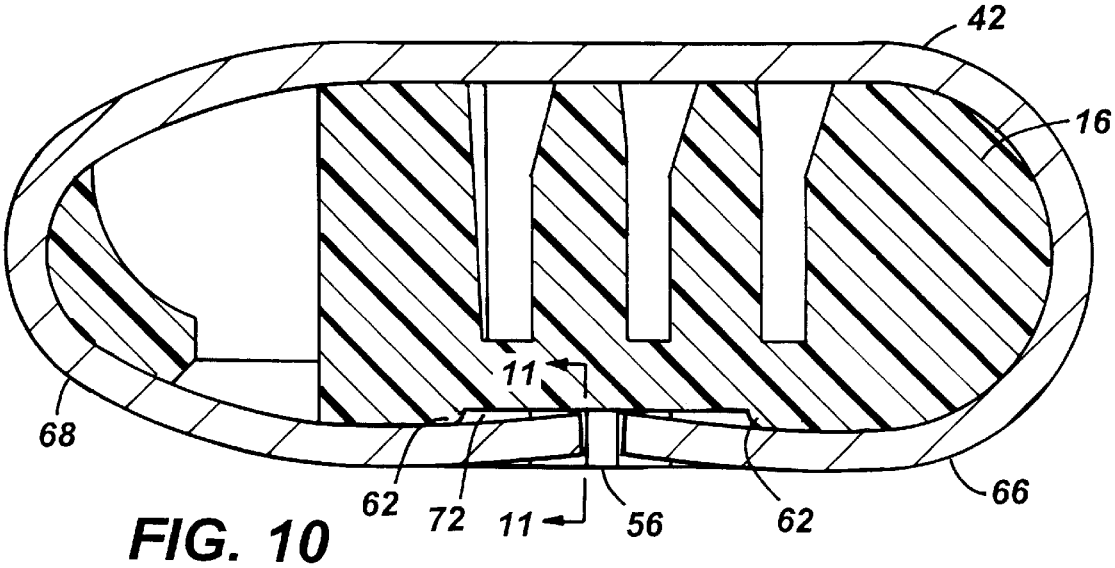
FIG. 10 is a vertical sectional view, taken at A—A of FIG. 3, of the assembled FIG. 2 blade unit with the ends of the retaining clip in a desired final position.
Figure 11:
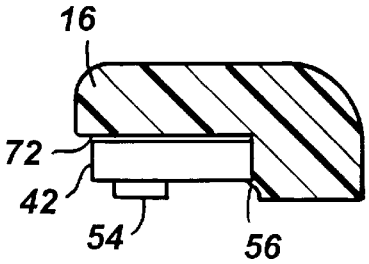
FIG. 11 is a partial vertical sectional view, taken at 11—11 of FIG. 10, showing the interference fit and overlying contact of a wedge portion of the housing and the retaining clip.

When the housing/blade/clip assembly is removed from forming die 100, the ends 50 tend to elastically return slightly to the position shown in FIGS. 10 and 11, though such movement is inhibited by the swaged plastic of wedges 56.

The interference fit between angled clip surfaces 60 and angled wedge surfaces 58 and the overlying swaged material (as shown in FIG. 11) tend to hold the ends of the clips 42 in place and to inhibit them from moving outward from housing 16. Also, notches 52 of clips 42 receive notch posts 54, causing end portions 50 of clips 42 to be captured between projections 42 and wedge portion surfaces 58 and to inhibit clip 42 from opening up during use, e.g., when the cartridge is subjected to excessive forces as might arise when the cartridge is dropped.

Other embodiments of the invention are within the scope of the appended claims.

What is claimed is:

1. A method of assembling a razor cartridge comprising providing a housing having a top, front and back sides, and a bottom, a first fulcrum portion extending outward from said bottom beyond first adjacent surface portions on two sides of said first fulcrum portion, said first fulcrum portion being spaced from a said side, said first adjacent surface portions being on said bottom on different sides of a longitudinal axis passing through said fulcrum, locating blades on said housing, and bending a U-shaped metallic retaining clip around said housing and blades located thereon beyond the elastic limit of said clip, said clip having a first end portion that bends over said first fulcrum portion and overlies said first adjacent surface portions.

2. The method of claim 1 wherein said providing includes providing said housing with a second fulcrum portion extending outward beyond second adjacent surface portions on two sides of said second fulcrum portion, and wherein said bending includes bending a second end portion of said clip over said second fulcrum portion beyond the elastic limit of the clip.

3. The method of claim 1 wherein said first fulcrum portion deforms and reduces in height by pressure applied to said first fulcrum portion during said bending of said first end portion about said first fulcrum portion.

4. The method of claim 1 wherein said housing has a raised edge adjacent to an edge of said clip that positions said clip on said housing.

5. The method of claim 2 wherein said housing is recessed inward at a portion of said housing adjacent to the ends of said clip to receive said end portions of said clip during bending.

6. The method of claim 5 wherein said providing includes providing said housing with a wedge portion extending outward beyond a third adjacent portion, and further comprising swaging said wedge portion over said ends of said clip in said recess so as to make an interference fit of said wedge portion with said clip to retain said clip on said housing.

7. A method of assembling a razor cartridge comprising providing a housing having a wedge portion extending outward beyond an adjacent portion, locating blades on said housing, bending a U-shaped metallic retaining clip around said housing and blades located thereon beyond the elastic limit of said clip, and swaging said wedge portion over ends of said clip so as to make an interference fit of said wedge portion with said clip to retain said clip on said housing.

8. The method of claim 4 wherein said housing has a raised edge adjacent to an edge of said clip that positions said clip on said housing.

9. The method of claim 4 wherein said housing is recessed at a portion of said housing adjacent to the ends of said clip to receive end portions of said clip during said bending and said swaging.

* * * * *

UNITED STATES PATENT AND TRADEMARK OFFICE

CERTIFICATE OF CORRECTION

PATENT NO. : 6,044,542
DATED : April 4, 2000
INVENTOR(S) : Apprille et al.

It is certified that error appears in the above-identified patent and that said Letters Patent is hereby corrected as shown below:

Claim 8,
Line 1, change "4" to -- 7 --.

Claim 9,
Line 1, change "4" to -- 7 --.

Signed and Sealed this

Fourth Day of September, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,044,542
DATED : April 4, 2000
INVENTOR(S) : Domenic Vincent Apprille, Jr. and Katherine Elizabeth Anderson It is certified that error appears in the above-identified patent and that said Letters Patent is hereby corrected as shown below:

Title page,
Change "Foreign Application Priority Data" to -- Related U.S. Application Data --
Delete "Nov. 25,1997 [EP] European Pat. Off.....97203691" and add
-- This is a divisional of 08/941,328 filed September 30, 1997, now issued as US Pat. 6,035,537. --

Signed and Sealed this

Fifth Day of February, 2002

*Attest:*

*Attesting Officer*

JAMES E. ROGAN
*Director of the United States Patent and Trademark Office*